US006009845A

United States Patent [19]

Ehrlich

[11] Patent Number: 6,009,845

[45] Date of Patent: Jan. 4, 2000

[54] INTERNAL COMBUSTION ENGINES

[75] Inventor: Josef Ehrlich, Hertfordshire, United Kingdom

[73] Assignee: Broadsuper Limited, London, United Kingdom

[21] Appl. No.: 09/192,178

[22] Filed: Nov. 10, 1998

Related U.S. Application Data

[63] Continuation of application No. PCT/GB97/01291, May 12, 1997.

[30] Foreign Application Priority Data

May 13, 1996 [GB] United Kingdom ..... 9609931

[51] Int. Cl.[7] ..... F02B 41/00

[52] U.S. Cl. ..... 123/197.4; 123/197.3; 123/78 E

[58] Field of Search ..... 123/197.4, 197.3, 123/48 B, 78 E, 78 F

[56] References Cited

U.S. PATENT DOCUMENTS

| | | | |
|---|---|---|---|
| 2,287,908 | 11/1942 | Schmidt | 123/197.4 |
| 4,538,557 | 9/1985 | Kleiner et al. | 123/48 B |
| 4,917,066 | 4/1990 | Freudenstei et al. | 123/197.4 |

FOREIGN PATENT DOCUMENTS

| | | |
|---|---|---|
| 0 248 655 A2 | 12/1987 | European Pat. Off. . |
| 1 316 536 | 12/1962 | France . |
| 41 16 742 A1 | 11/1992 | Germany . |
| 2 273 327 | 6/1994 | United Kingdom . |

*Primary Examiner*—Noah P. Kamen
*Assistant Examiner*—Jason Benton
*Attorney, Agent, or Firm*—Finnegan, Henderson, Farabow, Garrett & Dunner, L.L.P.

[57] ABSTRACT

An internal combustion engine including one or more pistons, each of which is mounted to reciprocate in a respective cylinder and is pivotally connected to a connecting rod which is connected to a respective crank on a crankshaft, characterized in that the connecting rod is pivotally connected to one end of an elongate link member which is pivotally connected to the associated crank at a position intermediate its ends and whose other end constitutes a rod which is restrained by a mounting such that it may pivot about a pivotal axis parallel to the axis of the crankshaft and may move in a direction parallel to its length.

7 Claims, 4 Drawing Sheets

INTERNAL COMBUSTION ENGINES

CROSS REFERENCE TO RELATED APPLICATIONS

This application is a continuation of International Application No. PCT/GB97/01291, filed May 12, 1997, the contents of which are incorporated therein by reference.

BACKGROUND OF THE INVENTION

The present invention relates to internal combustion engines of reciprocating piston type and is particularly, though not exclusively concerned with engines of the general type disclosed in EP-A-0591153.

This prior document discloses an engine in which the or each piston is caused to move over at least a portion of the cycle at a rate which is such that the graph of its displacement against time differs from the sinusoidal shape which is inherently produced in conventional engines in which each piston is connected to a respective crank on a crankshaft by a respective connecting rod. In such a conventional engine attempts are made to match the combustion of the fuel/air mixture to the motion of the piston but the philosophy underlying the construction of the prior document is that the combustion is permitted to proceed in the optimum manner and the piston is caused to move in a manner which "follows" the combustion and is related to the nature and progress of the combustion process.

More specifically, the prior document discloses an engine in which the piston is caused to decelerate and thus to move more slowly than in a conventional engine at or around the point in the cycle at which ignition of the fuel/air mixture occurs and then to speed up again prior to reaching the top dead centre position (TDC). This is based on the recognition that in a conventional engine the piston is moving at substantially its maximum speed at the point at which ignition occurs and the compression ratio is altering at substantially its maximum rate and thus impedes the rate of propagation of the flame front through the fuel/air mixture and thus impairs the nature and completeness of the combustion process. However, slowing the piston down at around the ignition point means that the rate of increase in the pressure of the fuel/air mixture at the time propagation of the flame front commences is substantially less than is usual which results in the flame front propagating through the fuel/air mixture very much more rapidly than as usual.

The prior document also discloses that the piston is caused to reach its maximum acceleration and maximum speed at something between 0 and 40° after TDC, instead of 90° after TDC as in a conventional engine and thereafter to move more slowly than in a conventional engine in the latter portion of its working stroke prior to reaching the bottom dead centre position (BDC). This results in a decreased temperature of the exhaust gases and thus in reduced emissions of NOx and reduced erosion of the exhaust ports and valves.

Extensive tests have been conducted on engines constructed in accordance with EP-A-0591153and these have shown that the engine does indeed have a substantially increased efficiency by comparison with conventional engines and also dramatically reduced emissions of unburnt hydrocarbons CO and NOx. Indeed, these tests have shown that the combustion process in the engines in accordance with the prior document proceeds in a manner which is fundamentally different to that in conventional engines, as evidenced by the fact that, for instance, the rate of pressure rise in the cylinder during combustion is about 6.5 bar per degree of rotation of the output shaft, as compared with about 2.5 bar in a conventional engine and that the combustion is complete within about 22° rotation of the output shaft after TDC, as compared to about 60° in a conventional engine.

However, the engine disclosed in the prior document incorporates profiled cams cooperating with the pistons and not a conventional crankshaft and whilst such cams are wholly functional and technically satisfactory it would be preferable for the engine to incorporate a crankshaft of generally conventional type because mass manufacturing facilities for crankshafts are already available and the technology for manufacturing crankshaft type engines is more familiar and tried and tested than that for cam type engines.

BRIEF SUMMARY OF THE INVENTION

Accordingly it is the object of the present invention to produce an internal combustion engine of reciprocating piston type in which the time displacement graph of the or each piston differs from the sinusoidal shape of conventional crankshaft type engines, e.g. in a manner similar to that disclosed in EP-A-0591153, and may preferably also be altered, when the engine is in operation, but which includes a crankshaft of generally conventional type.

According to the present invention there is provided an internal combustion engine including one or more pistons, each of which is mounted to reciprocate in a respective cylinder and is pivotally connected to a connecting rod which is connected to a respective crank on a crankshaft, characterised in that the connecting rod is pivotally connected to one end of an elongate link member which is pivotally connected to the associated crank at a position intermediate its ends and whose other end constitutes a rod which is restrained by a mounting such that it may pivot about a pivotal axis parallel to the axis of the crankshaft and may move in a direction parallel to its length.

Thus in the engine of the present invention the connecting rod is not directly pivotally connected to a respective crank but indirectly via one end of a link member which is pivotally connected to both the crank and the connecting rod. The other end of the link member is mounted so as to be pivotable about a third pivotal axis, which will be parallel to the other two, and to be linearly movable parallel to its length. The motion of piston will thus differ from the sinusoidal and may be varied at will by varying the spacing and relative positions of the three pivotal axes of the link member, which will in general not lie in a single plane. It is, however, preferred that the three pivotal axes are so positioned that the motion of the piston closely mimics that of the piston of the engine disclosed in EP-A-0591153, in particular that the piston is caused to move significantly more slowly at around the ignition point than in a conventional engine.

The mounting may take various forms and the relative longitudinal movability of the link member can be readily achieved by a sliding connection. It is, however. preferred that the mounting includes a first movable mounting member connected to a fixed mounting member to be pivotable with respect thereto about the pivotal axis, the first movable mounting member being connected to the rod by a connection which permits relative sliding movement in the direction of the rod. The relative slidability of the first movable mounting member and the rod may be provided by the movable mounting member having a hole therein in which the link member is longitudinally slidably received or if the movable mounting member has a spigot slidably received in the hole in the link member.

The invention is applicable to both two stroke and four stroke engines of both spark-ignited and diesel type. It may, however, be desirable to alter the motion of the piston, e.g. between the high and low load conditions and thus although the movable mounting member and thus also the third pivotal axis of the link member may be restrained from moving linearly transverse to the length of the link member, it is preferred that the mounting includes a second movable mounting member which is guided to move linearly with respect to the fixed mounting member in a direction transverse to the length of the rod, and actuating means cooperating with the second movable mounting member and arranged to move it linearly, the first movable mounting member being connected to the second movable mounting member to pivot with respect thereto about the pivotal axis. The actuating means may comprise opposed hydraulic cylinders or pneumatic cylinders or one or more cams or an eccentric peg cooperating with the second movable mounting member. If cams are used, it is preferred that there are two identical cams cooperating in opposition with the second movable mounting member, the two cams being coupled to rotate in synchronism, e.g. by means of a toothed belt in engagement with toothed pulleys carried by the same shafts as carried the cams. The actuating means may be controlled by the engine management system and thus caused to move the second movable mounting member and thus the third pivotal axis extremely rapidly.

In the event that the engine is of four-stroke type, it may be desirable for the motion of the piston to differ between the compression and exhaust strokes and perhaps even between the induction and working strokes also. This may be achieved in a variety of manners and in one preferred embodiment the actuating means is coupled to the crankshaft such that, when the engine is in operation, the second movable mounting member continuously reciprocates linearly. This reciprocation will be in phase with the movement of the associated piston whereby the motion of the piston will be the same on each compression stroke but will differ from that on the exhaust stroke.

The actuating means may be used not only to vary the manner in which the movement of the piston varies from the sinusoidal but may also be used, at least in part, to produce the variation and thus may be actuated during the course of a stroke of the piston, e.g. at or around the ignition point to produce the desirable deceleration of the piston at that point.

It is preferred that the pivotal axis about which the first movable mounting member pivots with respect to the second movable mounting member, when the axis is in the central position of its linear reciprocating travel, and the axis of rotation of the crankshaft lie in a plane which extends substantially perpendicular to the axis of the cylinder.

It is preferred also that the elongate link and the mounting are so dimensioned and arranged that, when the engine is in operation, the pivotal axis about which the connecting rod pivots with respect to the elongate link member describes a generally oval or elliptical path, the major axis of the ellipse extending generally parallel to the axis of the cylinder.

Whilst the two portions of the link member on opposite sides of the crank to which it is pivotally connected may be co-linear it is found to be preferable if they are in fact somewhat inclined to one another, e.g. by between 5 and 45°.

BRIEF DESCRIPTION OF THE DRAWINGS

Further features and details of the invention will be apparent from the following description of four specific embodiments which are given by way of example with reference to the accompanying drawings in which FIGS. 1 to 4 are respective highly diagrammatic, partly sectional scrap views of part of four multi-cylinder four stroke engines of which only one cylinder and the associated piston and the piston connecting mechanism are shown.

DETAILED DESCRIPTION OF THE INVENTION

Figure 1:
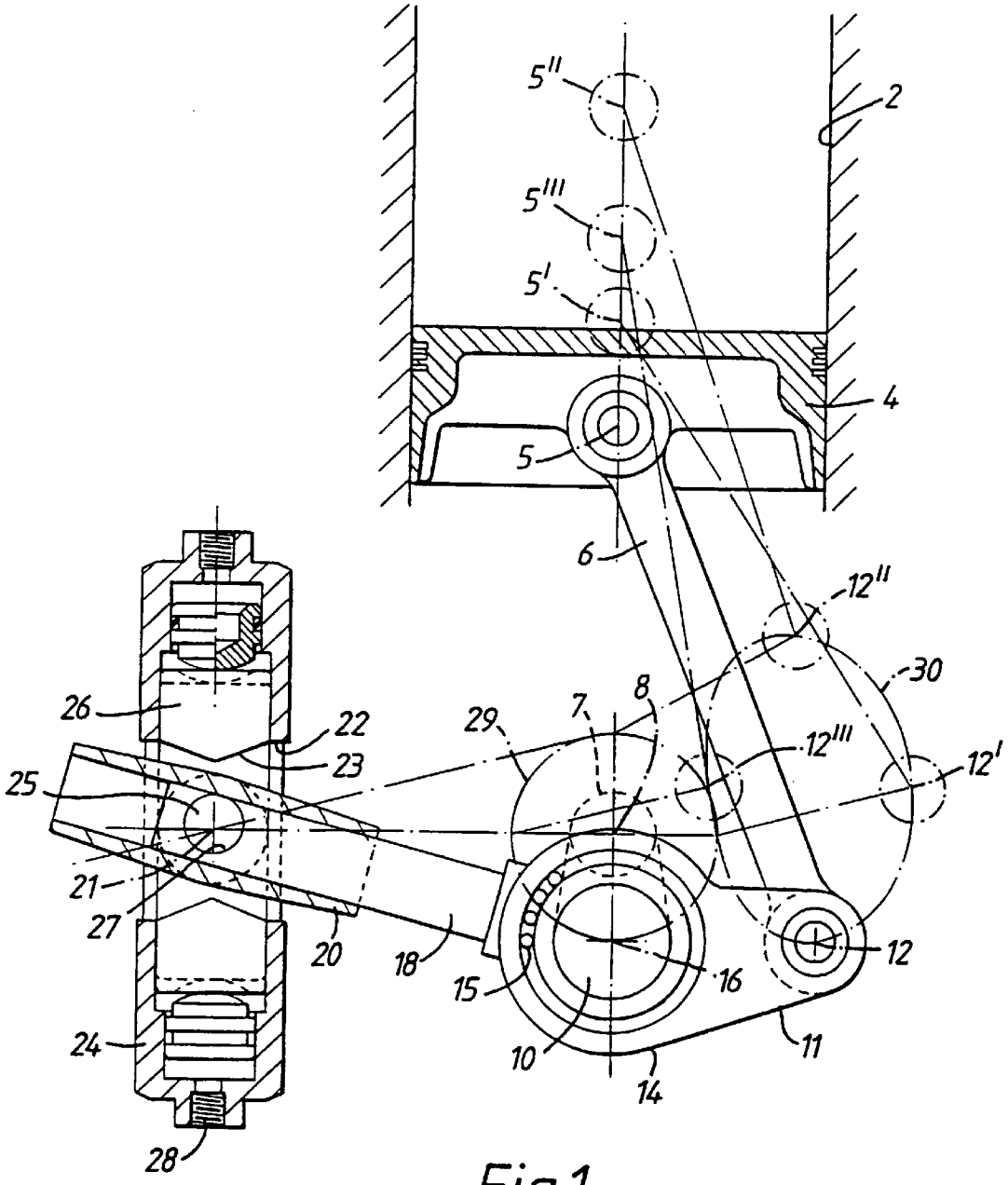
FIG. 1: Diagrammatic, partly scrap view of embodiment 1 of multi-cylinder engine four stroke engine with only one cylinder and the associated piston and the piston connecting mechanism.

In all four embodiments, the engine has four cylinders, though it may have more or less than this or even only a single cylinder, but only a single cylinder 2 is shown. Reciprocally mounted in the cylinder is a piston 4. The piston is pivotally connected about an axis 5 in the usual manner to a connecting rod 6. Extending below the or each cylinder 2, is a crank shaft 7, which is shown only diagrammatically in FIG. 1 and is not shown at all in FIGS. 2 and 3 for the sake of clarity and is mounted to rotate about an axis 8. The crankshaft carries a respective crank or crank throw 10 for each piston. The connecting rod 6 is however, not directly connected to the associated crank 10 but is instead pivotally connected about an axis 12 to one end 11 of a respective elongate link 14. The link is also pivotally connected about an axis 16 at a point intermediate its ends to the associated crank 10, with the interposition of an appropriate bearing 15. The other end 18 of the link 14, which is in the form of a solid or hollow bar, is longitudinally slidably received in a mounting. The construction of which is different in each of the embodiments.

In the first embodiment shown in FIG. 1, the mounting includes a movable mounting member 20 constituted by a sleeve which passes through a diarnetral hole 22 in a stationary mounting member constituted by a hollow tube or sleeve 24, which is typically connected to the crankcase (not shown), and through a hole 23 in an otherwise solid second movable mounting member 26 which is accommodated and guided in the interior of the stationary mounting member 24. Projecting from the exterior of the sleeve 20 at a point intermediate its ends are two opposed bearing trunnions 25 which are rotatably received in respective opposed bores 27 formed in the side wall of the second movable mounting member 26, which is longitudinally slidable within the fixed mounting member 24, to pivot about a further pivotal axis 21, whereby the sleeve 20 may pivot or rotate to a limited extent about the trunnions with respect to the mounting member 24, and may also move linearly to a limited extent in the direction of the length of the mounting member 24.

The movable mounting member 26 is opposed to diametrically opposed areas of the exterior of the sleeve 20. The movable mounting member 26 may be moved longitudinally within the mounting member 24 by the application of hydraulic or pneumatic pressure to its rear surfaces via ports 28 formed at each end of the mounting member 24. Alternatively the mounting member 26 may be moved indirectly by the application to its rear surfaces of an actuating force by respective hydraulic or pneumatic pistons.

In use, the pivotal axis 21 usually remains stationary and, as the crankshaft 10 rotates and the piston 4 reciprocates within the cylinder 2, the axis 16 of the crank 10 describes a circular path 29 and the rod 18 slides in and out of the sleeve 20, which rocks back and forth about its trunnions 25. The sleeve 20 restrains the rod 18 from moving linearly transverse to its length. The pivotal axis 12 is constrained by the kinematics of the system to move along a somewhat irregular path 30, shown in FIG. 1, which has a somewhat deformed oval or substantially elliptical shape. Four specific positions which it occupies during one revolution of the crankshaft are designated 12, 12',12",12'", respectively, and the corresponding positions of the axis 5 are designated 5, 5',5",5'", respectively. The mechanism results in the position/time graph of the piston differing from the conventional sinusoidal shape but the precise manner in which it varies will depend on the relative positions of the axes 12,16 and 21. These are predetermined to produce the required pattern of motion of the piston, e.g. one that approximates to that of the engine disclosed in EP-A-0591153.

The pattern of the motion of the piston may be varied by altering the position of the pivotal axis 21. This may be done by moving the movable mounting member 26 thereby moving the sleeve 20 in the direction of the length of the fixed mounting member 24. Movement of the position of the axis 21 may be effected at the end of one or more of the piston strokes during each cycle in order to produce different patterns of movement in e.g. the compression and exhaust strokes. Alternatively it may be effected in order to adapt the combustion optimally to different load conditions. As a further alternative the axis 21 may be moved in the course of one or more of the piston strokes to produce a desired variation in the pattern of motion of the piston from the sinusoidal. In any event, movement of the sleeve 20 by the movable mounting member 26 may be effected extremely rapidly e.g. under the control of the engine management system which is now provided in most modern automotive engines.

Figure 2:
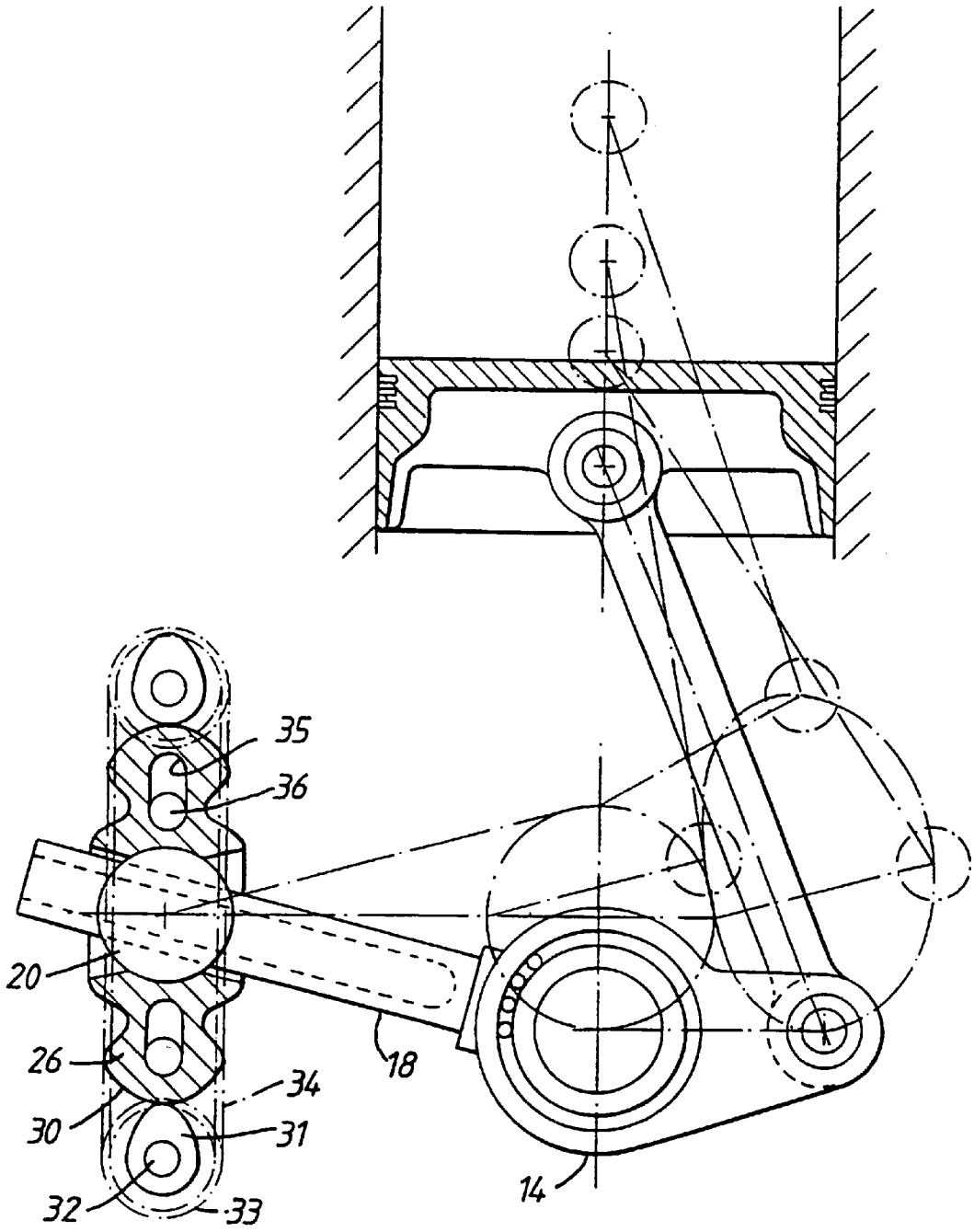
FIG. 2: Diagrammatic, partly scrap view of embodiment 2 of multi-cylinder engine four stroke engine with only one cylinder and the associated piston and the piston connecting mechanism.

In the second embodiment illustrated in FIG. 2, the second end of the link 14 constituted by the bar 18 is hollow for weight-saving purposes and passes through a hole in the first movable mounting member 20, which is constituted by a ball or cylinder, and is slidably retained therein. The movable mounting member 20 is retained in a hole extending through a second movable mounting member 26 by virtue of the engagement of its circular section external surface by opposed complementary surfaces afforded by the mounting member 26. The mounting member 20 may thus rotate with respect to the mounting member 26 about the axis 21 but may not move linearly with respect to it. The rod 18 may thus move only in rotation and linearly parallel to its length with respect to the mounting member 26.

The mounting member 26 has two opposed arcuate ends 30 which are in engagement with two identical cams 31, which are 180° offset from one another. The cams 31 are carried by respective shafts 32 which also carry respective toothed pulleys 33. A toothed belt 34 passes over the two pulleys 34 which means that they and thus the cams 31 are thus constrained to rotate in synchronism in the same sense. One or both of the shafts 32 is connected to an actuator (not shown), which is controlled by e.g. the vehicle engine management system, for intermittent or continuous rotation, as required, in order to produce the desired pattern of movement of the piston.

The movable mounting member 26 is constrained to move linearly parallel to its length by the provision in it of two elongate slots 35, projecting through which are respective guide pegs 36. The pegs 36 are connected to the fixed mounting member, which is not shown for the sake of clarity and which is typically connected to or constituted by a portion of the crankcase.

Figure 3:
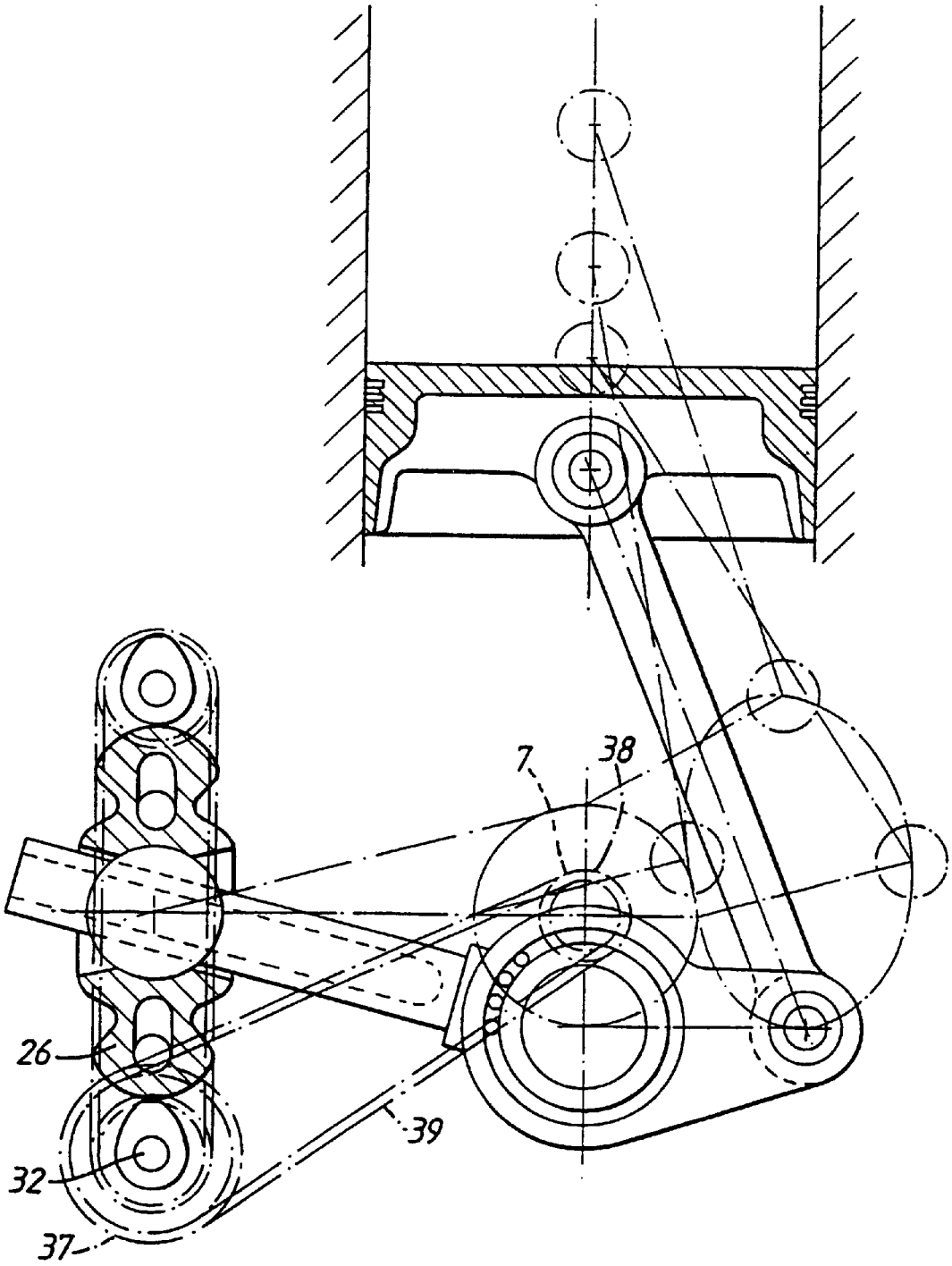
FIG. 3: Diagrammatic, partly scrap view of embodiment 3 of multi-cylinder engine four stroke engine with only one cylinder and the associated piston and the piston connecting mechanism.

The embodiment illustrated in FIG. 3 is very similar to that illustrated in FIG. 2 but in this case one of the shafts 32 carries a further toothed pulley 37 and the crankshaft 7 also carries a toothed pulley 38 or a portion of its periphery is toothed and constitutes such a pulley. A toothed belt 39 passes over the two pulleys 37, 38 and rotationally links them. The pulleys 37, 38 are so sized that one revolution of the crankshaft 7 results in half a revolution of the pulley 37. This will mean that the linear reciprocation of the second movable mounting member 26 is in phase with the operating cycle of the engine. The motion of the piston will therefore be the same on e.g. each compression stroke but this will differ to the motion on each exhaust stroke. The movable mounting member 26 is shown at TDC, i.e. at its closest position to the piston, and the piston is shown at BDC and the piston is about to perform its compression stroke. It is found that this results in a more pronounced retardation of the piston at around the ignition point and thus in the motion of the piston more closely mimicking that of the piston in EP-A-0591153.

Figure 4:
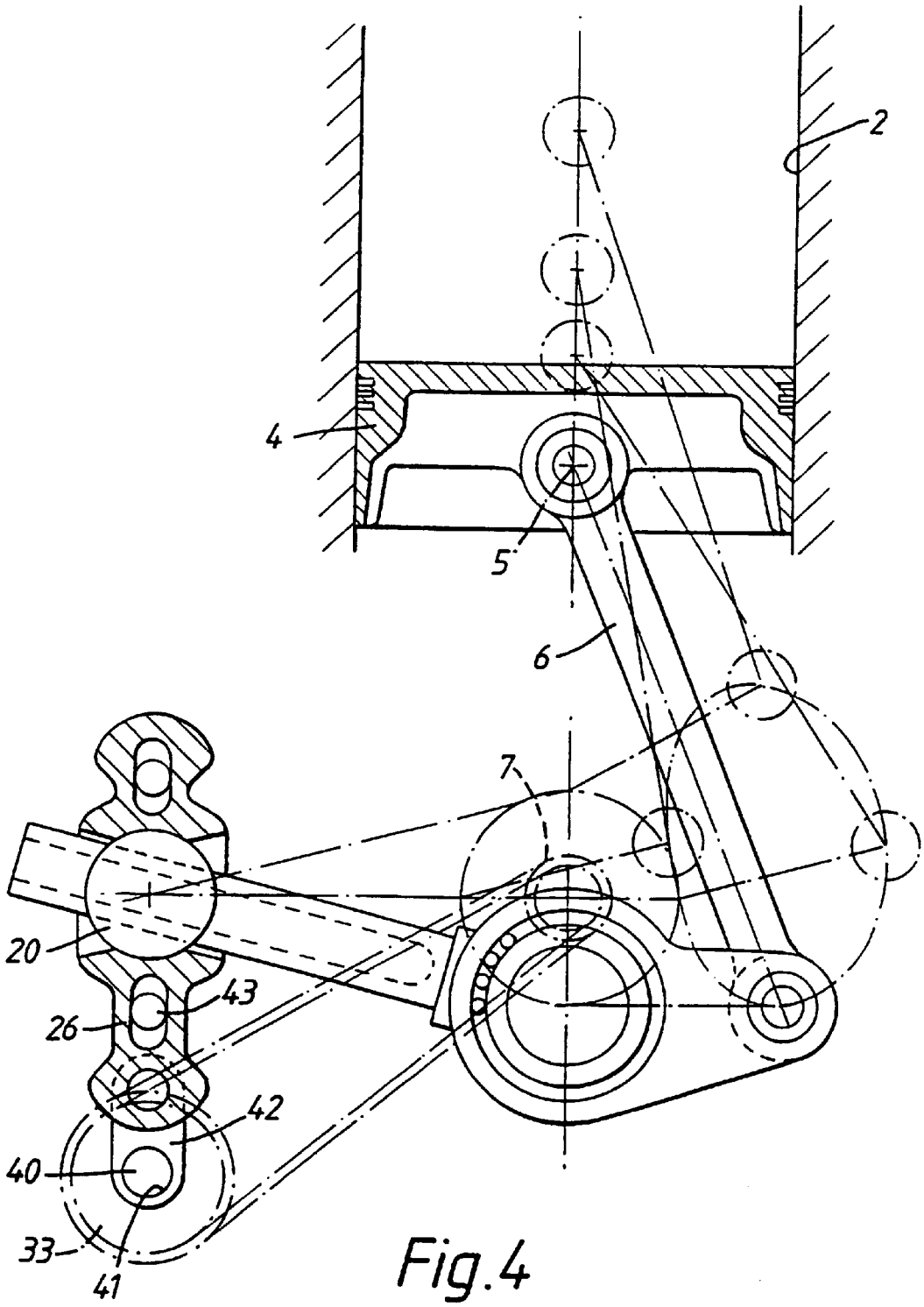
FIG. 4: Diagrammatic, partly scrap view of embodiment 4 of multi-cylinder engine four stroke engine with only one cylinder and the associated piston and the piston connecting mechanism.

The embodiment of FIG. 4 is very similar to that of FIG. 3 but in this case the cam drive for effecting reciprocating motion of the mounting members 20, 26 is replaced by an eccentric drive. Thus the cams 31 are omitted as are also one of the pulleys 33 and the toothed belt 34. The remaining pulley 33 is provided with an eccentric peg 40 which is pivotably accommodated in a hole 41 of the same diameter formed in one end of an elongate link 42. The other end of the link 42 is provided with a hole through which and through a corresponding hole in the associated end of the movable mounting member 26 a further pivot pin 43 passes. Accordingly, rotation of the crankshaft 7 results in rotation of the peg 40 about the axis of the pulley 33 which in turn results in reciprocating linear motion of the movable mounting member 26 parallel to its length with an amplitude which is determined by the eccentricity of the peg 40.

In all the embodiments referred to above the motion of the piston closely mimics that of the piston in the engine disclosed in EP-A-0591153. Thus the piston decelerates substantially at or around the point at which ignition occurs and then speeds up again prior to reaching TDC. The piston also reaches its maximum acceleration and maximum speed at something between 0 and 40° after TDC, instead of around 90° after TDC, as in a conventional engine, and thereafter moves somewhat more slowly than in a conventional engine in the latter portion of its working stroke prior to reaching BDC. The dwell period at BDC is also prolonged as compared to a conventional engine. If it is desired to further delay the dwell period at BDC, the relative timing of the movable mounting member 26 and the piston may be altered in the embodiments of FIGS. 3 and 4 and this further increases the volumetric efficiency.

I claim:

1. An internal combustion engine comprising one or more pistons, each mounted to reciprocate in a respective cylinder and pivotally connected to a connecting rod pivotally connected to one end of a elongate link member pivotably connected at a point intermediate its ends to an associated crank on a crankshaft having an axis, the other end of the link being a rod restrained by a mounting such that the rod may pivot about a pivotal axis parallel to the axis of the crankshaft, the mounting including a fixed mounting member, a first movable mounting member, and a second movable mounting member, the first movable mounting member being pivotally connected to the second movable mounting member on said pivotal axis, the first movable mounting member surrounding the rod to permit only sliding movement of the rod relative to the first movable mounting member in the direction of the rod, wherein the fixed mounting member includes a guide to cause the second movable mounting member to move linearly with respect to the fixed mounting member in a direction transverse to the length of the rod, and further including actuating means for linearly moving the second movable mounting member.

2. An engine as claimed in claim 1 wherein the actuating means includes at least one cam cooperating with the second movable mounting member.

3. An engine as claimed in claim 2 wherein the actuating means includes two identical cams cooperating in opposition with the second movable mounting member, the two cams being coupled to rotate in synchronism.

4. An engine as claimed in claim 1 wherein the actuating means includes an eccentric peg cooperating with the second movable mounting member.

5. An engine as claimed in any one of claims 1 or 2 to 4 wherein the actuating means is coupled to the crankshaft such that the second movable mounting member is reciprocated linearly upon rotation of the crankshaft.

6. An engine as claimed in any one of claims 1 or 2 to 4 wherein the pivotal axis, when in a central position of linear travel by movement of the second movable mounting member, and the axis of rotation of the crankshaft lie in a plane which extends substantially perpendicular to the axis of the cylinder.

7. An engine as claimed in any one of claims 1 or 2 to 4 wherein the connecting rod is connected to the elongate link member to pivot about a pivotal connection axis, the elongate link member and the mounting being so dimensioned and arranged that, when the engine is in operation the pivotal connection axis describes a generally elliptical path, the major axis of the elliptical path extending substantially parallel to the axis of the cylinder.

* * * * *